US010252559B2

(12) United States Patent
Ballestrazzi et al.

(10) Patent No.: US 10,252,559 B2
(45) Date of Patent: Apr. 9, 2019

(54) ASSEMBLY AND METHOD FOR REALIZING IN CONTINUOUS COVERING JACKETS OF DIFFERENT DIMENSIONS STARTING FROM A FILM WRAPPED UP IN A COIL

(75) Inventors: Aris Ballestrazzi, Savignano Sul Panaro (IT); Lamberto Tassi, Savignano Sul Panaro (IT)

(73) Assignee: SITMA MACHINERY S.p.A., Modena (IT)

( * ) Notice: Subject to any disclaimer, the term of this patent is extended or adjusted under 35 U.S.C. 154(b) by 450 days.

(21) Appl. No.: 13/488,737

(22) Filed: Jun. 5, 2012

(65) Prior Publication Data

US 2012/0308335 A1 Dec. 6, 2012

(30) Foreign Application Priority Data

Jun. 6, 2011 (IT) ..... MI2011A1016

(51) Int. Cl.

| | |
|---|---|
| ***B42C 5/00*** | (2006.01) |
| ***B42C 9/00*** | (2006.01) |
| ***B42C 11/00*** | (2006.01) |
| ***B42C 13/00*** | (2006.01) |
| ***B42C 7/00*** | (2006.01) |
| ***B42C 11/02*** | (2006.01) |

(Continued)

(52) U.S. Cl.

CPC ..... *B42C 7/00* (2013.01); *B65H 45/18* (2013.01); *B65H 45/28* (2013.01); *B42D 3/045* (2013.01); *B65H 2801/48* (2013.01)

(58) Field of Classification Search

CPC ..... B42C 9/00; B42C 11/00; B42C 13/00; B42C 7/00; B42C 11/02; B42C 5/00; B42C 5/02

USPC .... 412/1, 4, 5, 9, 11, 13, 17, 19, 24, 30, 37, 412/900

See application file for complete search history.

(56) References Cited

U.S. PATENT DOCUMENTS 2,195,959 A * 4/1940 Maguire ..... B31F 1/0029 156/481
2,640,207 A * 6/1953 De Florez ..... B42C 15/00 412/24

(Continued)

FOREIGN PATENT DOCUMENTS

DE 41 32 681 A1 4/1993
EP 1 070 600 A1 1/2001

(Continued)

OTHER PUBLICATIONS

Italian Search Report dated Jan. 31, 2012, in Italian MI20111016, filed Jun. 6, 2011 (with English Translation of Categories of Cited Documents).

*Primary Examiner* — Justin V Lewis
(74) *Attorney, Agent, or Firm* — Oblon, McClelland, Maier & Neustadt, L.L.P.

(57) ABSTRACT

An assembly for realizing in continuous covering jackets of book elements of different dimensions starting from a film wrapped up in a coil. The assembly includes a mechanism for cutting the film unrolling from the coil for realizing pieces of the film; a first folding device of a first end of the pieces; a second folding device of a second end of the pieces; a control and command unit and a longitudinal welder suitable for both superiorly and inferiorly closing folded pockets and for regulating the height of the cover itself by trimming the parts in excess.

16 Claims, 16 Drawing Sheets

(51) Int. Cl.

| | |
|---|---|
| ***B42C 5/02*** | (2006.01) |
| ***B65H 45/28*** | (2006.01) |
| ***B65H 45/18*** | (2006.01) |
| *B42D 3/04* | (2006.01) |

(56) References Cited

U.S. PATENT DOCUMENTS

| | | | | |
|---|---|---|---|---|
| 2,992,153 | A * | 7/1961 | Lutwack | B42C 7/00 156/154 |
| 5,498,112 | A * | 3/1996 | Schwettmann et al. | 412/4 |
| 6,460,843 | B1 * | 10/2002 | Dim et al. | 412/4 |
| 6,613,178 | B1 | 9/2003 | Di Bernardo | |
| 2003/0059280 | A1 * | 3/2003 | Stevens | 412/1 |
| 2003/0215309 | A1 * | 11/2003 | Engert | B42C 19/08 412/33 |
| 2005/0020425 | A1 * | 1/2005 | Kawatsu | B65H 45/18 493/424 |
| 2009/0016850 | A1 * | 1/2009 | Sorita | B42C 11/02 412/37 |
| 2009/0257846 | A1 * | 10/2009 | Matsushita | B26F 1/0092 412/6 |
| 2010/0109313 | A1 * | 5/2010 | Fuchs | B42B 5/10 281/27.1 |
| 2012/0257947 | A1 * | 10/2012 | Mueller | 412/37 |

FOREIGN PATENT DOCUMENTS

| | | | | |
|---|---|---|---|---|
| GB | 2 155 857 | | 10/1985 | |
| WO | WO 2007096005 | A1 * | 8/2007 | B42C 7/00 |

* cited by examiner

ASSEMBLY AND METHOD FOR REALIZING IN CONTINUOUS COVERING JACKETS OF DIFFERENT DIMENSIONS STARTING FROM A FILM WRAPPED UP IN A COIL

The present invention refers to an assembly and to a method for realizing in continuous covering jackets for book elements of different dimensions starting from a film wrapped up in a coil.

Today it is known to provide books, which are generally used frequently, such as for example text books used by students, with a protection for the cover which preserves them for the longest time possible.

However, it is a common experience that on the market it is not easy to find covering jackets with always suitable dimensions for the books to be protected.

The result is that it is often necessary to make them by hand with paper or film and adhesive tape, taking up a considerable amount of time and reaching a result that is depending on the individual skills.

Furthermore, such covering jackets made from paper or coloured film cover up the title of the book making it difficult to identify it.

The purpose of the present invention is that of making an assembly and a method for realizing in continuous covering jackets for book elements of different dimensions starting from a film wrapped up in a coil that is capable of solving the aforementioned drawbacks of the prior art in an extremely simple, cost-effective and particularly functional manner.

Another purpose is that of making an assembly and a method for realizing in continuous covering jackets for book elements of different dimensions starting from a film wrapped up in a coil that is capable of producing covering jackets having the dimensions of the book that are required each time, and of allowing it to be personalized graphically with the title, subject, class, logo, name of the client or student, price, bar codes or sorting and identification codes of the book or product.

These purposes according to the present invention are achieved by making an assembly and a method for realizing in continuous covering jackets for book elements of different dimensions starting from a film wrapped up in a coil as outlined in claim 1.

Further characteristics of the invention are highlighted in the dependent claims.

The characteristics and advantages of an assembly and of a method for realizing in continuous covering jackets for book elements of different dimensions starting from a film wrapped up in a coil according to the present invention shall become clearer from the following description, given as an example and not for limiting purposes, with reference to the attached schematic drawings, in which.

Figure 1:
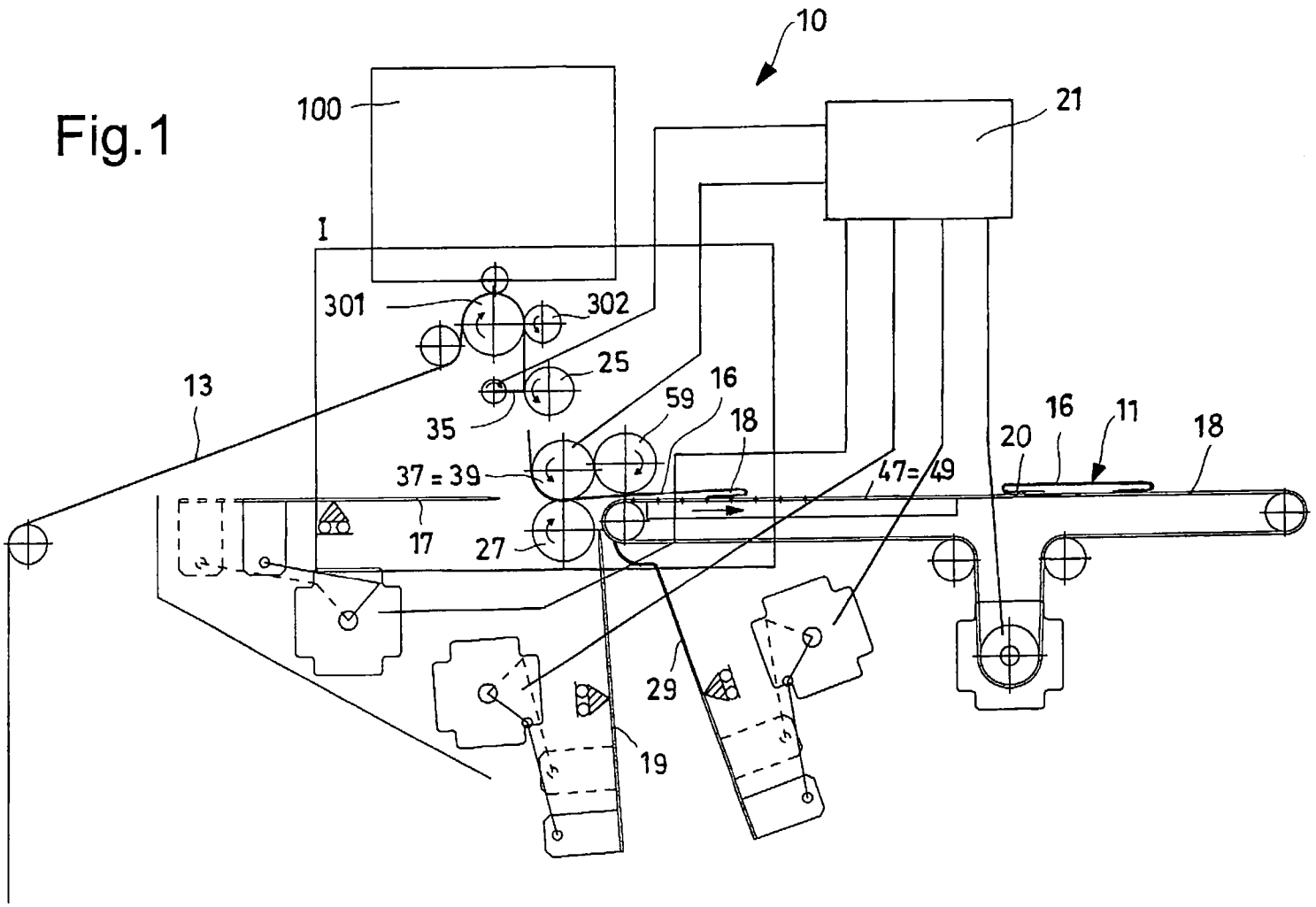
FIG. 1 is an elevation view of an assembly for realizing in continuous covering jackets for book elements of different dimensions starting from a film wrapped up in a coil according to the present invention.

With reference to the figures, reference numeral 10 shows an embodiment of an assembly according to the present invention for realizing in continuous covering jackets for book elements of different dimensions starting from a film wrapped up in a coil.

Of course, by the term film we mean both plastic films or material in the form of rolls of paper or other, and the term book element comprises actual books but also magazines or other typographic products intended to be flipped through when being read, like for example catalogues.

Such an assembly 10, schematically shown in FIG. 1, comprises means 15, 25, 35 for cutting the film 13 during the unrolling from the coil 14 for realizing pieces 16 of film 13, a first folding device 17, 27, 37 of a first end 18 of such pieces 16 and a second folding device 19, 39, 59 of a second end 20 of the same pieces 16.

The assembly 10 moreover comprises a control and command unit 21 of the cutting means 15 and/or of the first 17, 27, 37, and second 19, 39, 59 folding device according to the characteristic dimensions A, B, C of the book element 12 which must be covered.

In such a way, by operating on the control of the cutting and/or on the length of the folded portions it is possible to make a covering jacket that is perfectly dimensioned with respect to the book to which it must be associated.

The characteristic dimensions of the book, as shall be outlined in greater detail in the description of the operation of the assembly 10, can already be pre-emptively memorized in the unit of a control and command unit 21, can be transmitted to it remotely by remote code reading means or they can be read directly by sensors arranged on the assembly 10 so as to provide, to the user, the book already joined with the relative covering jacket to be associated.

Therefore, advantageously, at the moment of ordering a book, the client can request for it to be given to him already protected with the covering jacket irrespective of the dimensions of the book and for it to possibly be personalised with logo, name, title, subject, etc.

As shown, the cutting means 25, 35 comprise a roller 25 facing a rotating cutting element 35, when required by the control and command unit 21, so as to cut the film 13 fed in continuous by the unwinding rollers 301 and 302 upstream of the cutting means.

Also the aforementioned unwinding rollers 301 and 302 are controlled at a variable speed to control the dimensions of the pieces 16.

In particular, such a roller 25 and the cutting element 35 act as a knife with a rotating blade and a contrast drum and provide for cutting the film at the correct length necessary so as to bind the product comprising also two folds, called "pockets", where the front and back covers of the book to be protected will be put. Therefore such a cutting is made according to the height A, or thickness, and to the width B of the book. As described, the assembly 10 comprises a first 17, 27, 37 and a second 19, 39, 59 folding device respectively for realizing the front 18 and back 20 pockets of the covering jacket 11.

Also such folding devices operate according to the height A, or thickness, and to the width B of the book. In the preamble of the description it is specified that even only one from the cutting means 25, 35 and folding device can operate in a "controlled" manner while the remaining ones operate in a periodic cyclical manner. Indeed, in the case in which the cutting is cyclical in order to realize pieces 16 all having the same dimensions, it is sufficient to vary the length of the pockets 18, 20 so as to adapt the cover to the book. Vice versa, in the case in which the folding is constant, for example making all pockets 18, 20 of the same dimension, it is sufficient to vary the length of the piece 16 so as to adapt the cover 11 to the book 12.

Of course, by acting in a controlled and variable manner both on the length of the piece 16 and on the length of the pockets 18, 20 it is possible to obtain all possible combinations.

In particular, in such a last way, pockets can be made with variable dimensions according to the requirements. The first folding device 17, 27, 37 provides for folding a first end 18 of a piece 16 of film 13 which moves forward downstream of the cutting means.

Both in the description of the machine and in the operation details, we shall mention that such a first folding device 17, 27, 37 acts on the end of one piece 16, however, this is not totally correct.

In fact, the first folding device 17, 27, 37 acts on the end 18 even before the cutting means have cut also the opposite end 20 of the film 13.

However, such a clarification does not affect the description of the machine but only makes coherent what is shown in the drawings.

The folding device 17, 27, 37 comprises a first pair of rollers 27, 37 placed in mutual contact in order to realize a first calendar passage for the film 13, a first mobile folding knife 17 configured so as to force the film 13 forwarding inside such a first calendar passage.

Downstream of the first folding device 17, 27, 37 an aspirated belt 47 is provided for receiving and constraining the first folded end 18.

It is also possible to foresee a connection plane 401 between the rollers 27, 37 and the plane 47.

Analogously, the second folding device 19, 29, 49, which acts on the second end 20 of the piece 16 comprises a second pair of rollers 39, 59 placed in mutual contact in order to realize a second calendar passage; a second mobile folding knife element 19 configured so as to force the film 13 into the second calendar passage.

Downstream of the rollers 39, 59, a belt 49 is provided activatable in outwards and return to selectively feed and remove the film 13 with respect to the second pair of rollers 39, 59.

Furthermore, also a guide 29, for receiving the second folded end 20 and for directing the same on the aspirated belt 49, acts together with the second folding device 19, 39, 59.

The coordinated movement of the two folding devices, which, as already mentioned, act on the film according to the height A, or thickness, and to the width B of the book, will be described in detail in the description of the operation of the assembly 10.

In the shown embodiment, the assembly 10 is compact due to the fact that the roller 39 and the aspirated belt respectively coincide with the roller 37 and the aspirated belt 47.

It is possible to complete the assembly 10 with a printing device 100, for example placed upstream of the cutting means 25, 35 acting on the film 13 so as to allow it to be personalized graphically with film 13 itself, and a welding and longitudinal cutting device 101 closed above, for example placed downstream of the second folding device 19, 39, 49, for cutting and welding the piece 16 folded according to the length C of the book 12.

In particular, the welding and longitudinal cutting device 101, which comprises one longitudinal fixed welder and one that can be regulated so as to adapt to the length C of the book 12 and consequently form a cover jacket of the suitable dimension, is necessary for closing superiorly and inferiorly.

It is very easy to understand how the assembly for realizing in continuous covering jackets for book elements of different dimensions starting from a film wrapped up in a coil object of the invention operates. The assembly 10, according to the present invention, realizes in continuous covering jackets for book elements of different dimensions starting from a film wrapped up in a coil.

In particular the control and command unit 21 moves the members for cutting and folding the film according to the characteristic dimensions A, B, C of the book to be covered.

Such characteristic dimensions A, B, C can be received remotely and memorized in the control and command unit or they can be measured in situ along a line equipped with sensors 201, 202, 203, for measuring the book 12.

Advantageously, if such a line is directed with the discharge 204 downstream of the second folding device 19, 39, 49 at a discharge belt 205 of the assembly 10, there is also the physical coupling of the book 12 with the corresponding covering jacket 11 thus avoiding every possible error and promoting the coupling of the cover with the correct book.

In general the method according to the present invention for realizing in continuous covering jackets 11 of book elements 12 of different dimensions starting from a film 13 wrapped up in a coil 14, comprises the phases of:

- cutting the film 13 unrolling from the coil 14 for realizing pieces 16 of film 13;
- folding both the first 18 and the second 20 end of the pieces 16 so as to make the front and back pockets;
- longitudinally welding the cover to close superiorly and inferiorly the pockets 18 and 20 and to regulate the height of the cover itself, by means of the control and command unit 21, according to the dimension C of the book.

FIGS. 2-14 show the phases in sequence of making the covering jacket 11.

Figure 2:
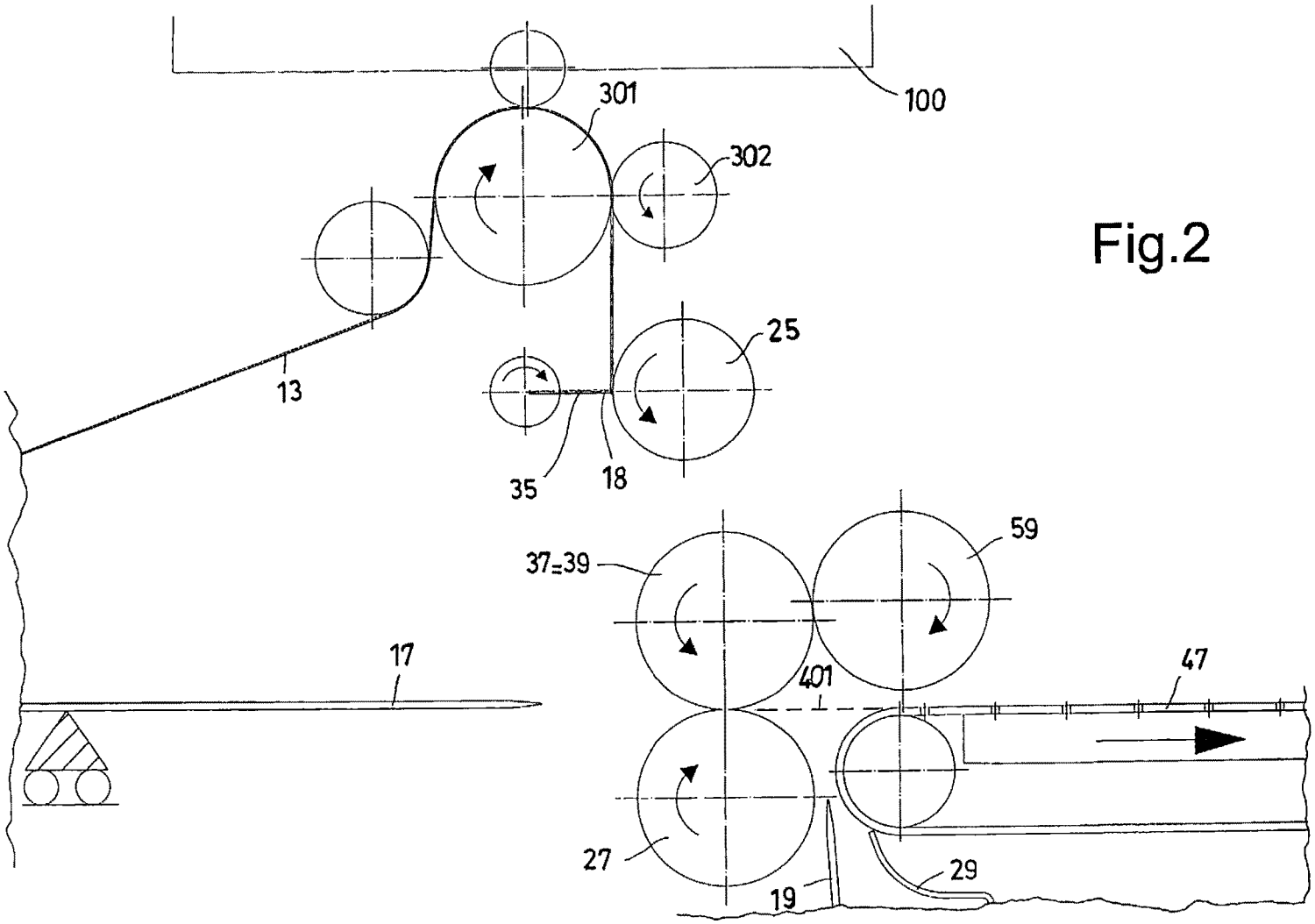
FIGS. 2-14 show in succession phases for realizing covering jackets by means of the assembly of FIG. 1.
Figure 3:
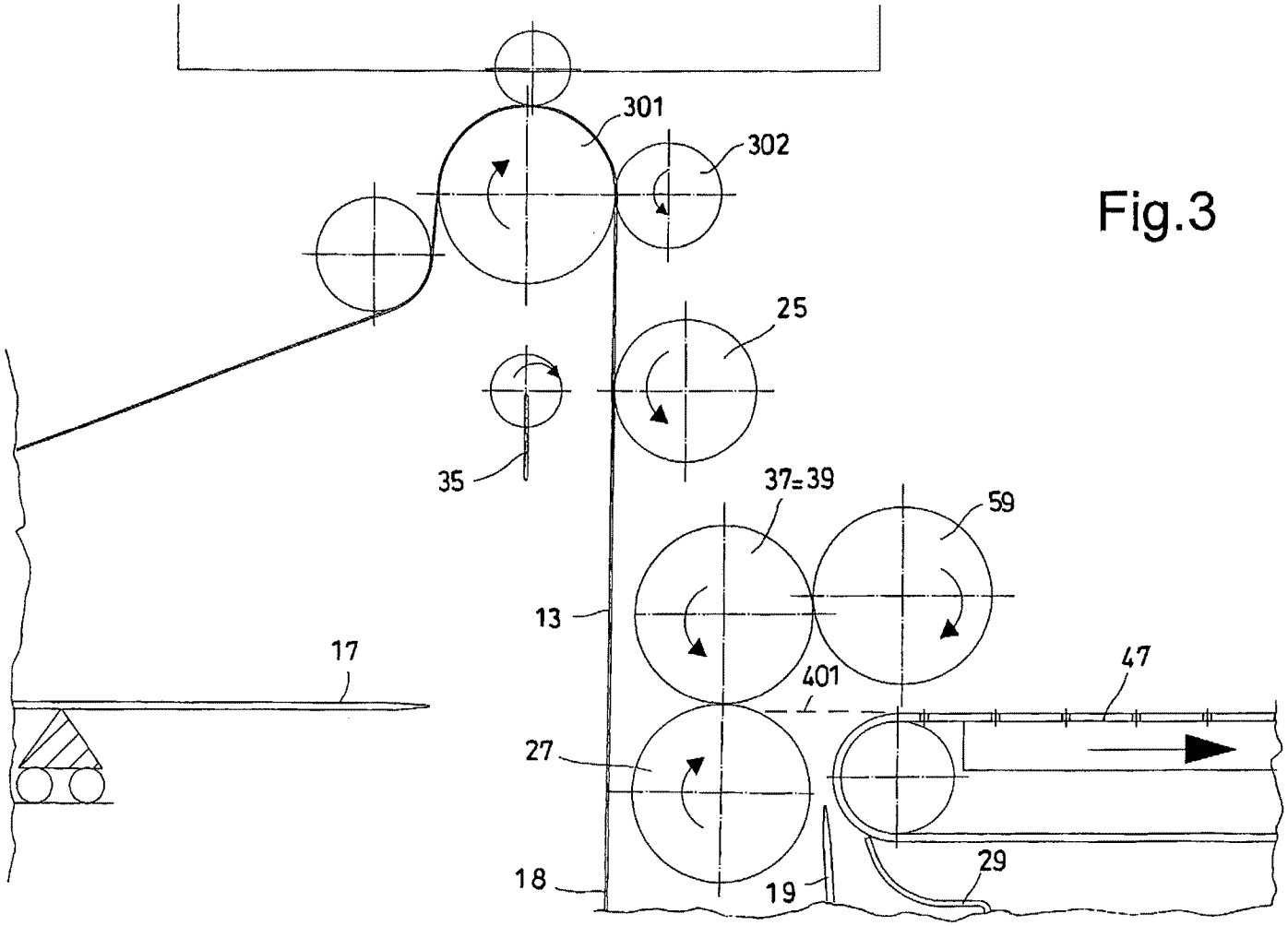

Initially, FIGS. 2 and 3, the blade 35 provides for cutting the film 13 which, with its ends 18, is directed upstream of the rollers 37 and 27.

Figure 4:
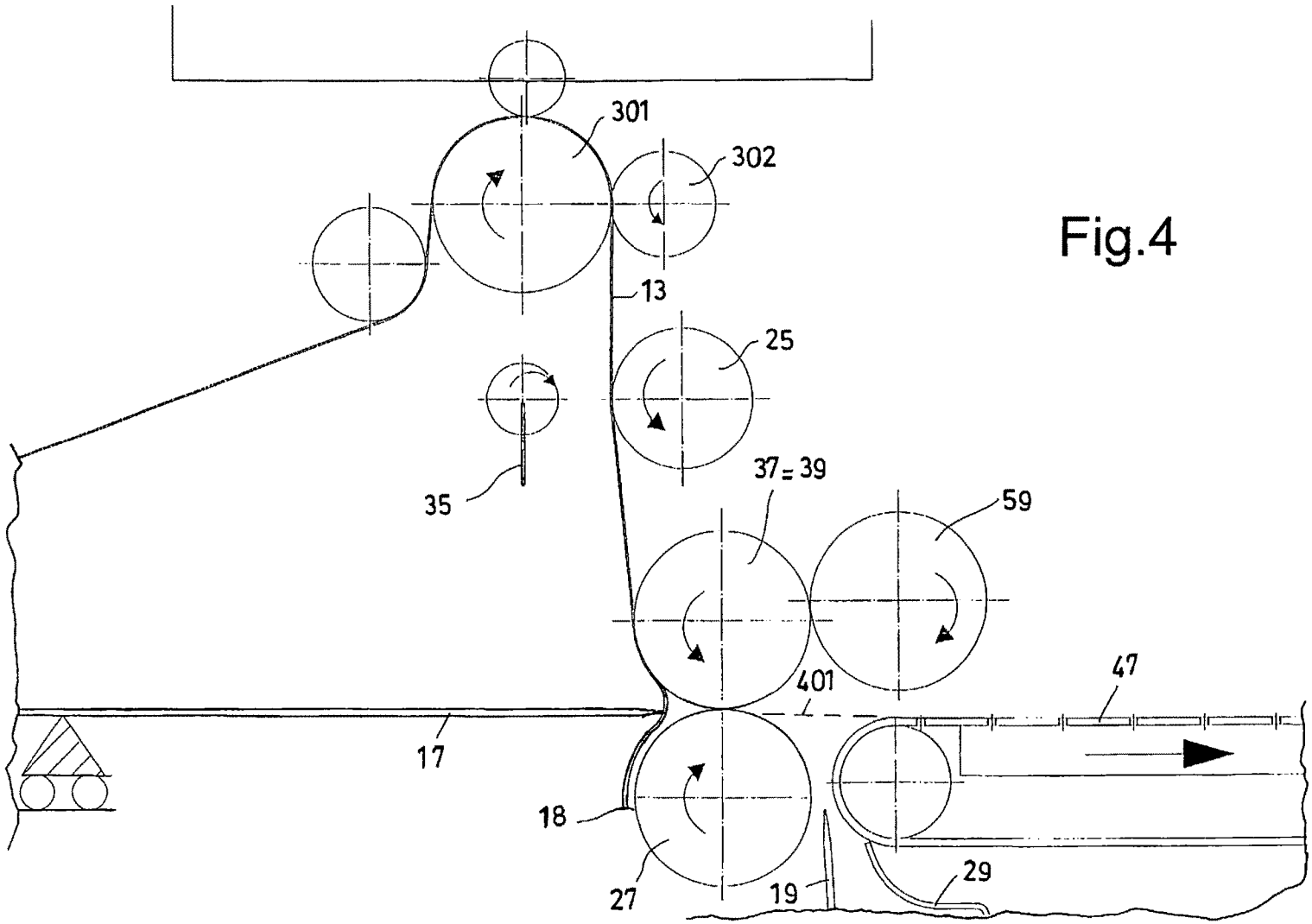
Figure 5:
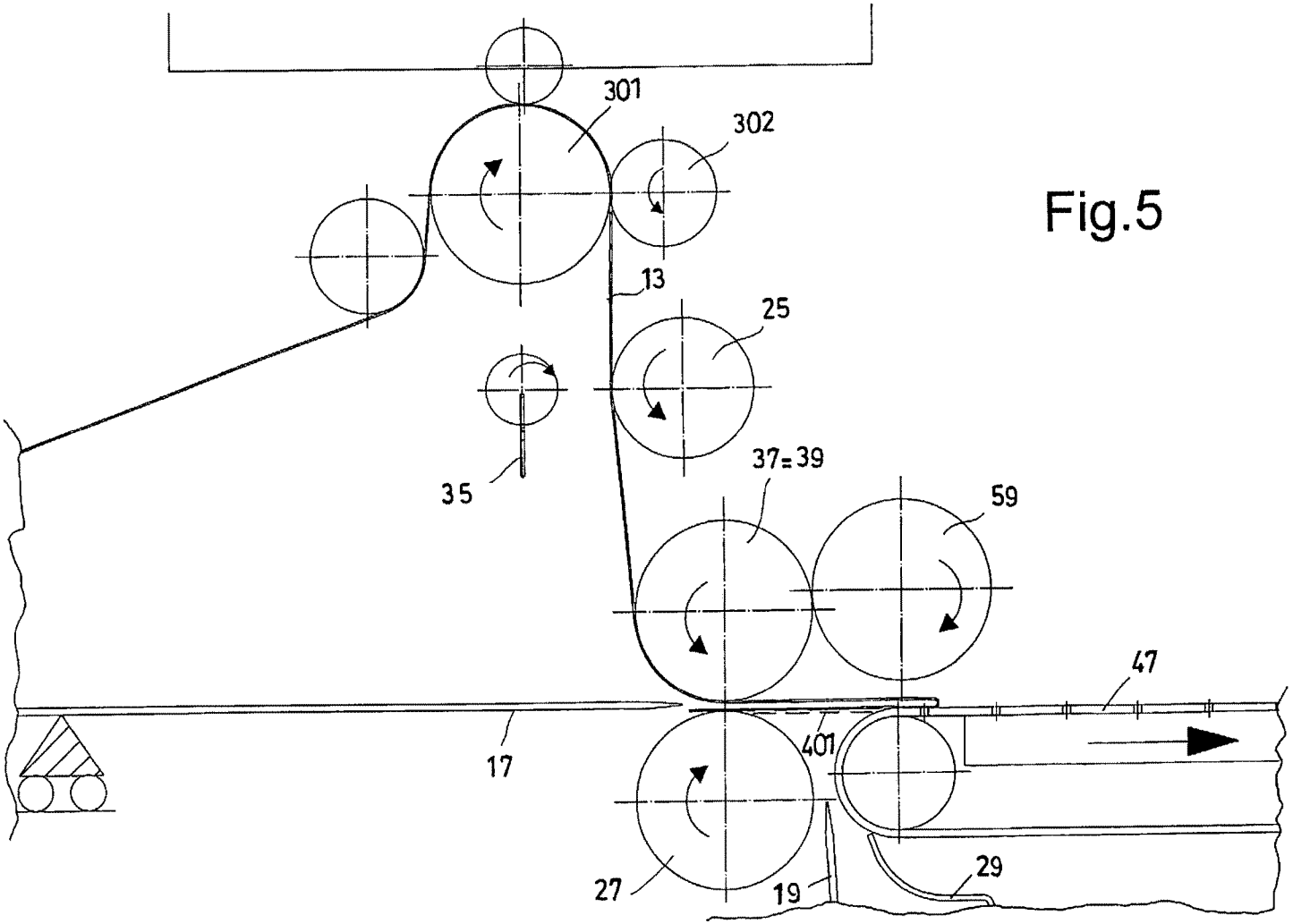

At this stage, FIG. 4, the first folding knife 17 moves and forces the film 13 to enter in the calendar passage formed by the rollers 37 and 27.

In order to allow and facilitate such a penetration of the film inside the rollers, at least one of the two rollers is spring-loaded and is actuated in rotation.

Figure 6:
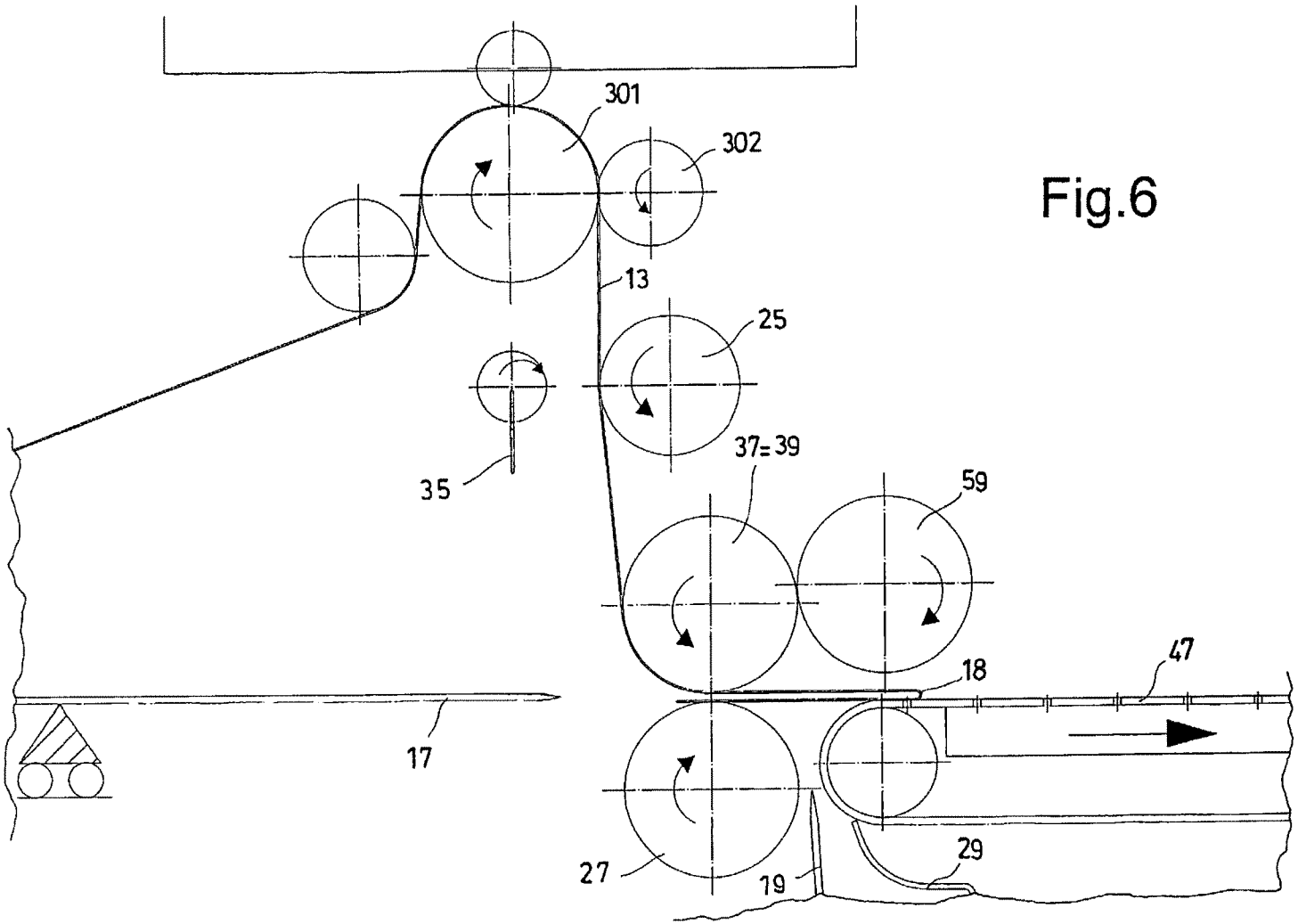
Figure 7:
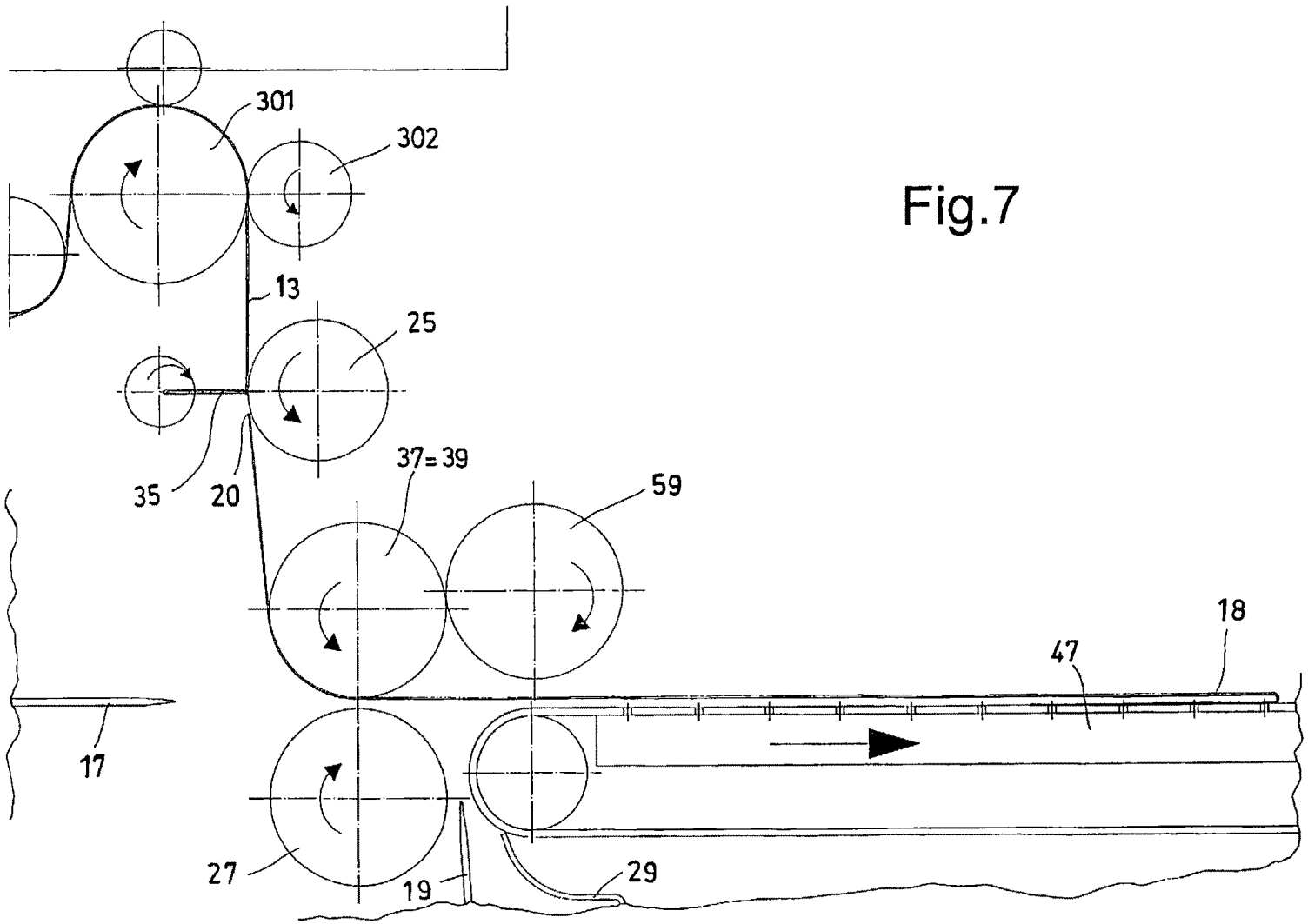

By effect of the rollers, the pocket 18 continues its journey until the folded film 13 comes into contact with the aspirated belt 47, which provides for both keeping the length of the pocket correct and pulling back on it also the other end 20 of the piece 16, as shown in FIGS. 6 and 7.

The plane 401 helps such a passage of the cover of the rollers to the belt 47.

In such a condition, the knife 17 can be brought back into the resting position.

Figure 8:
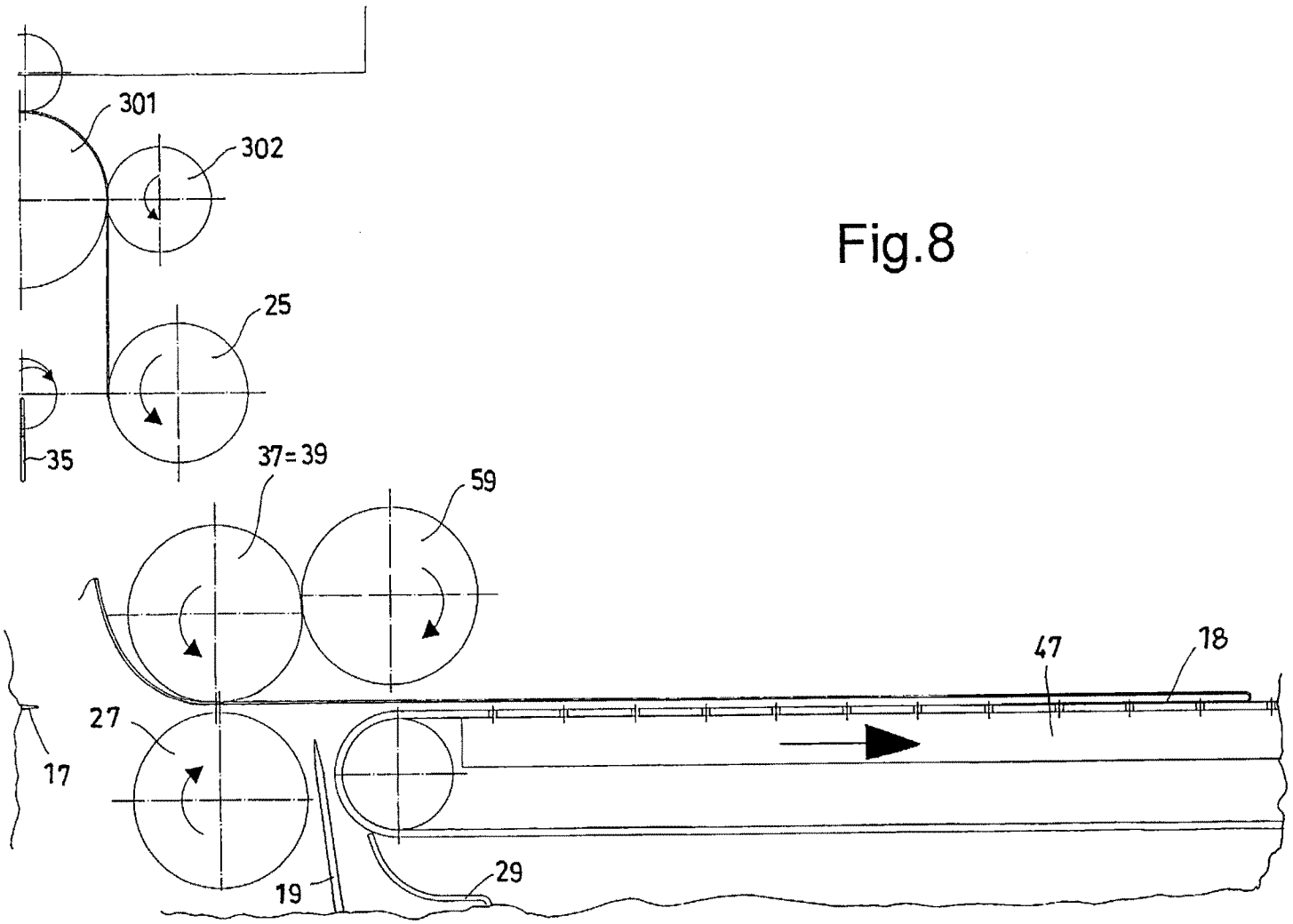
Figure 9:
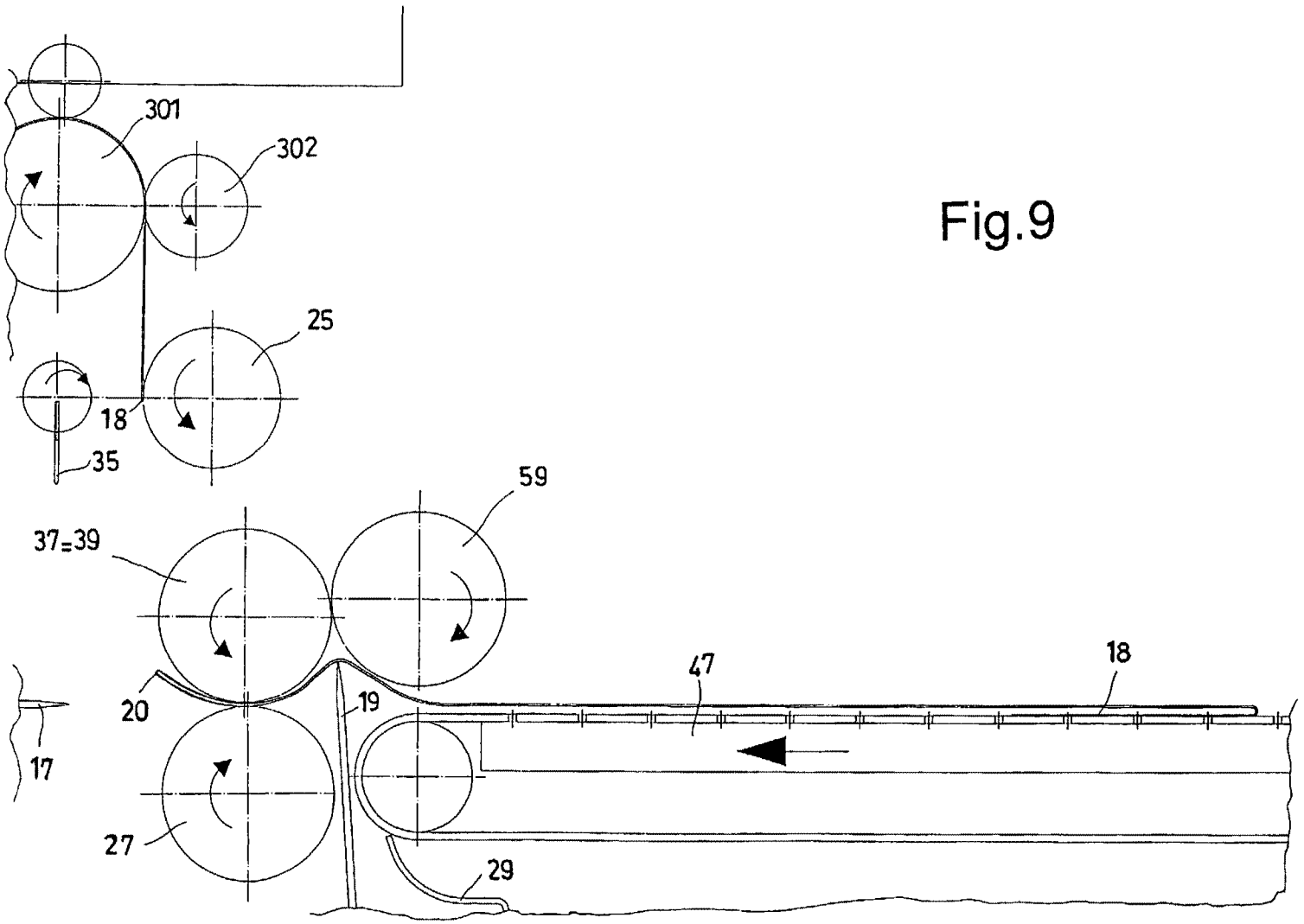

Once a certain unwinding length of the piece on the aspirated belt 47 has been reached, FIG. 8, the latter reverses its movement while simultaneously the second knife 19 acts on the second end 20 of the piece 16, FIG. 9, forcing it to enter inside the calendered passage formed by the rollers 39 and 59, of which at least one is spring-loaded.

Figure 10:
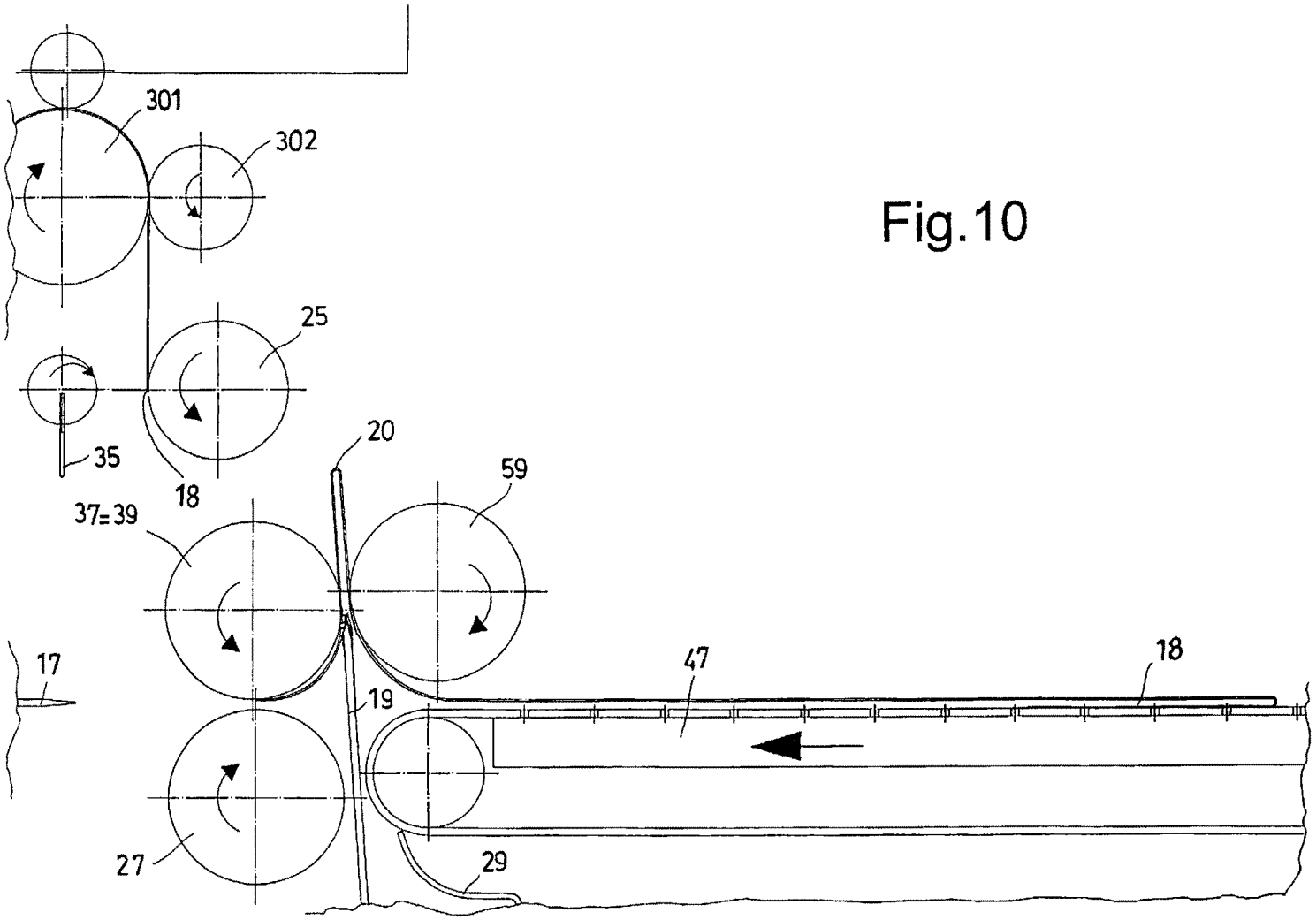
Figure 11:
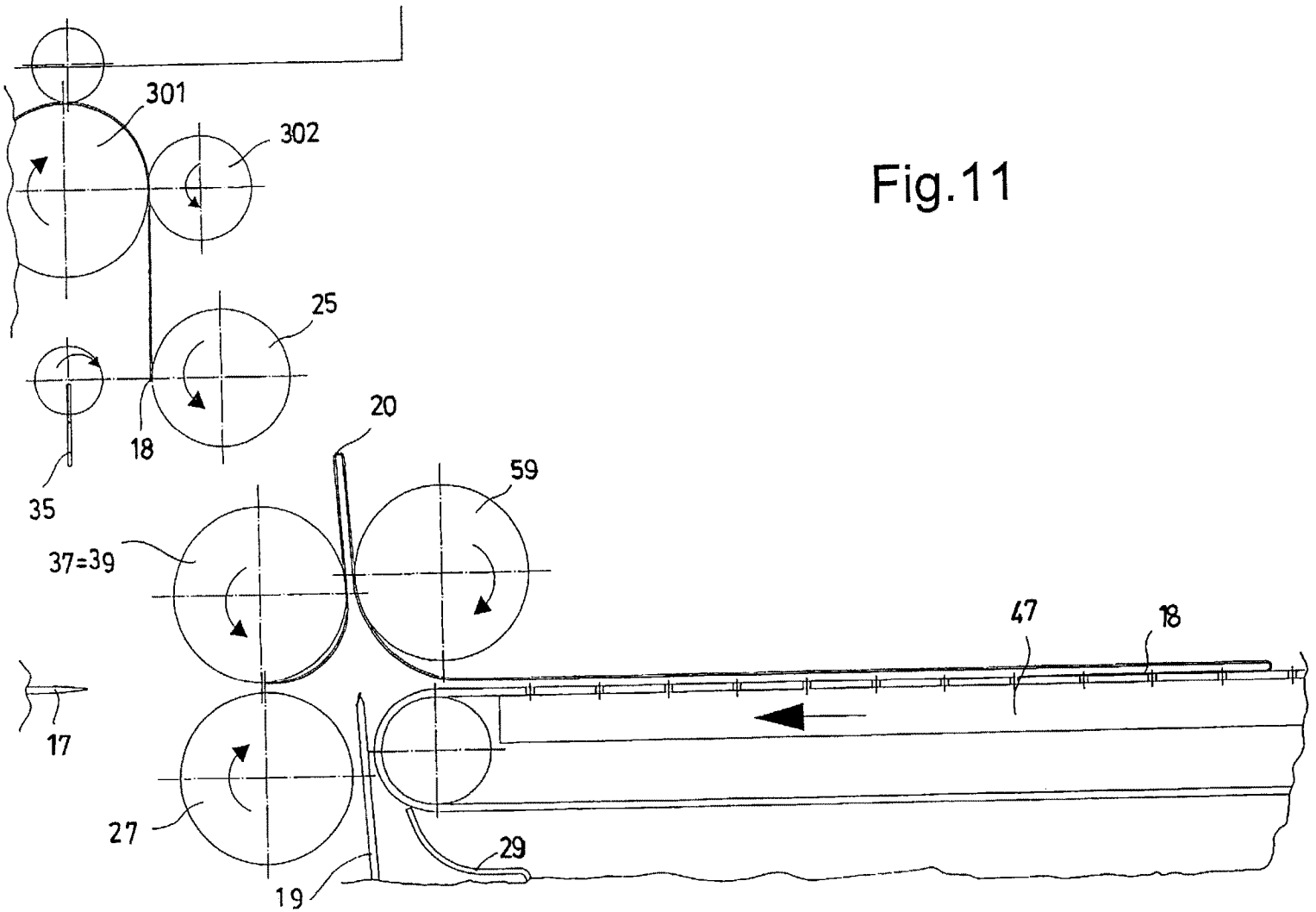

Thanks to the reversed movement of the aspirated belt 47 and to that of the rollers 39 and 59, the second pocket 20 is made, FIG. 10.

At this stage the knife 19 can be brought back into the resting condition.

In order to deposit also the second pocket 20 on the belt 47, once the pocket 20 has been formed with the required dimensions, both the movement of the belt 47 and of the rollers 39, 59 are reversed.

Figure 12:
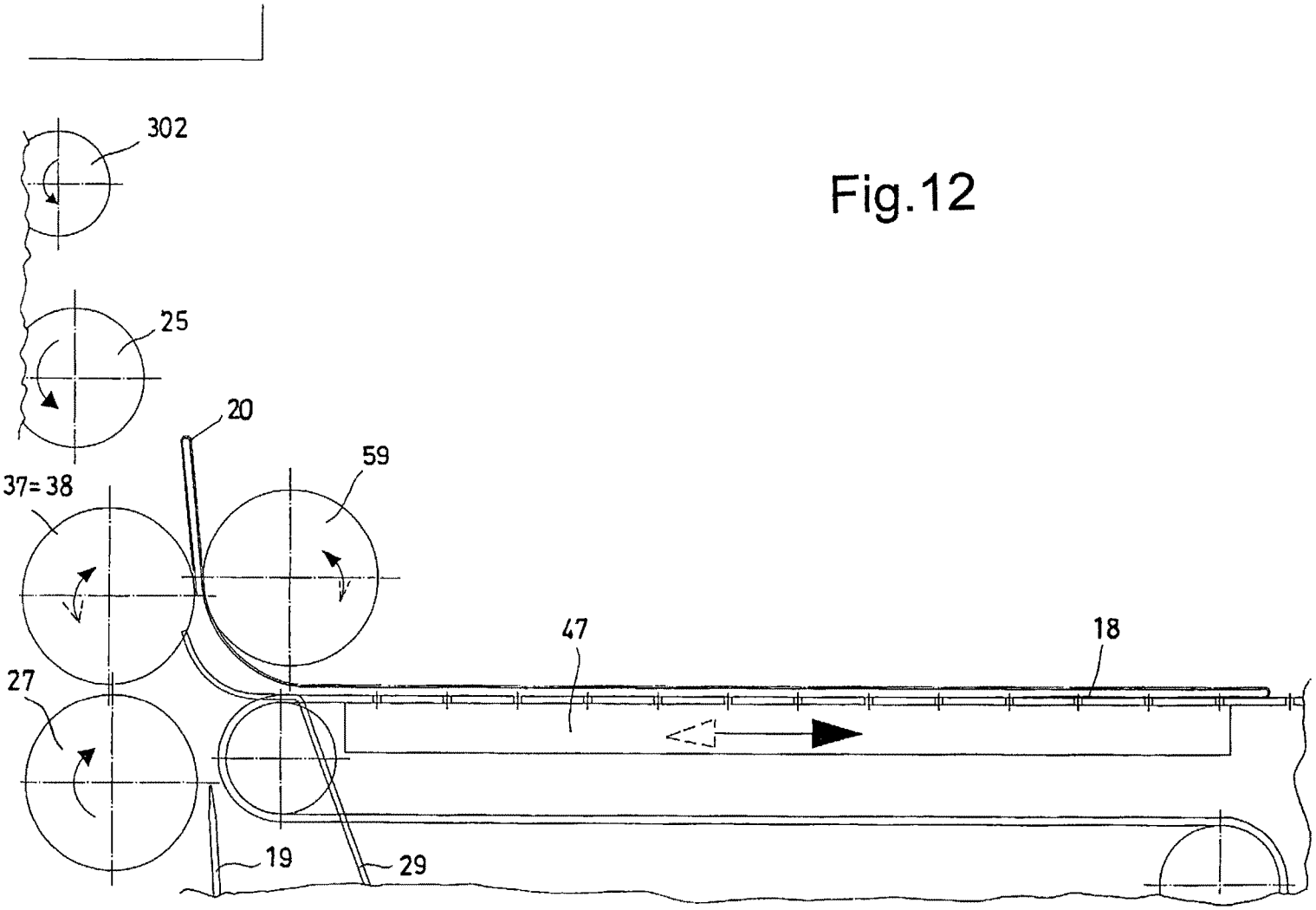
Figure 13:
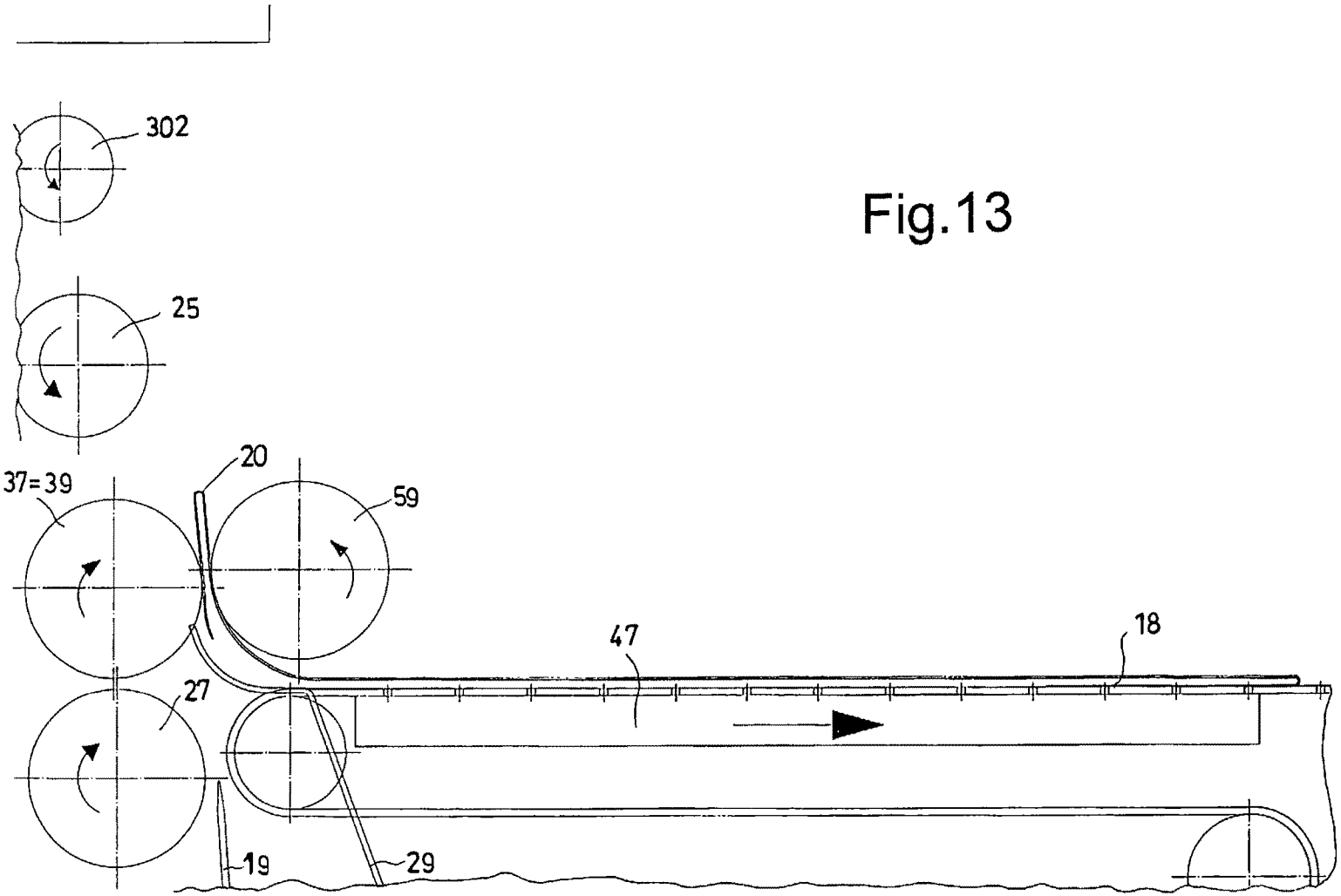
Figure 14:
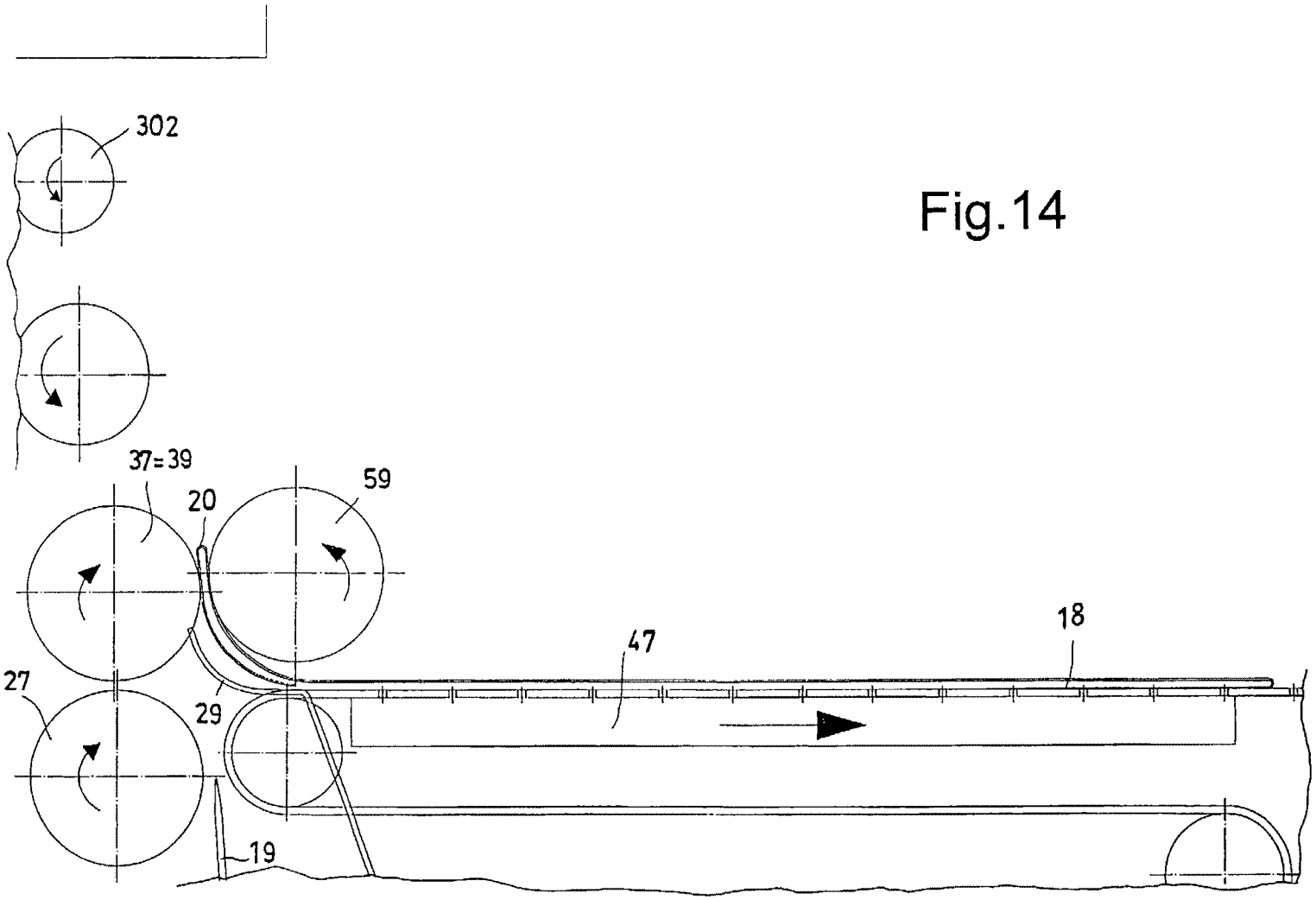
Figure 15:
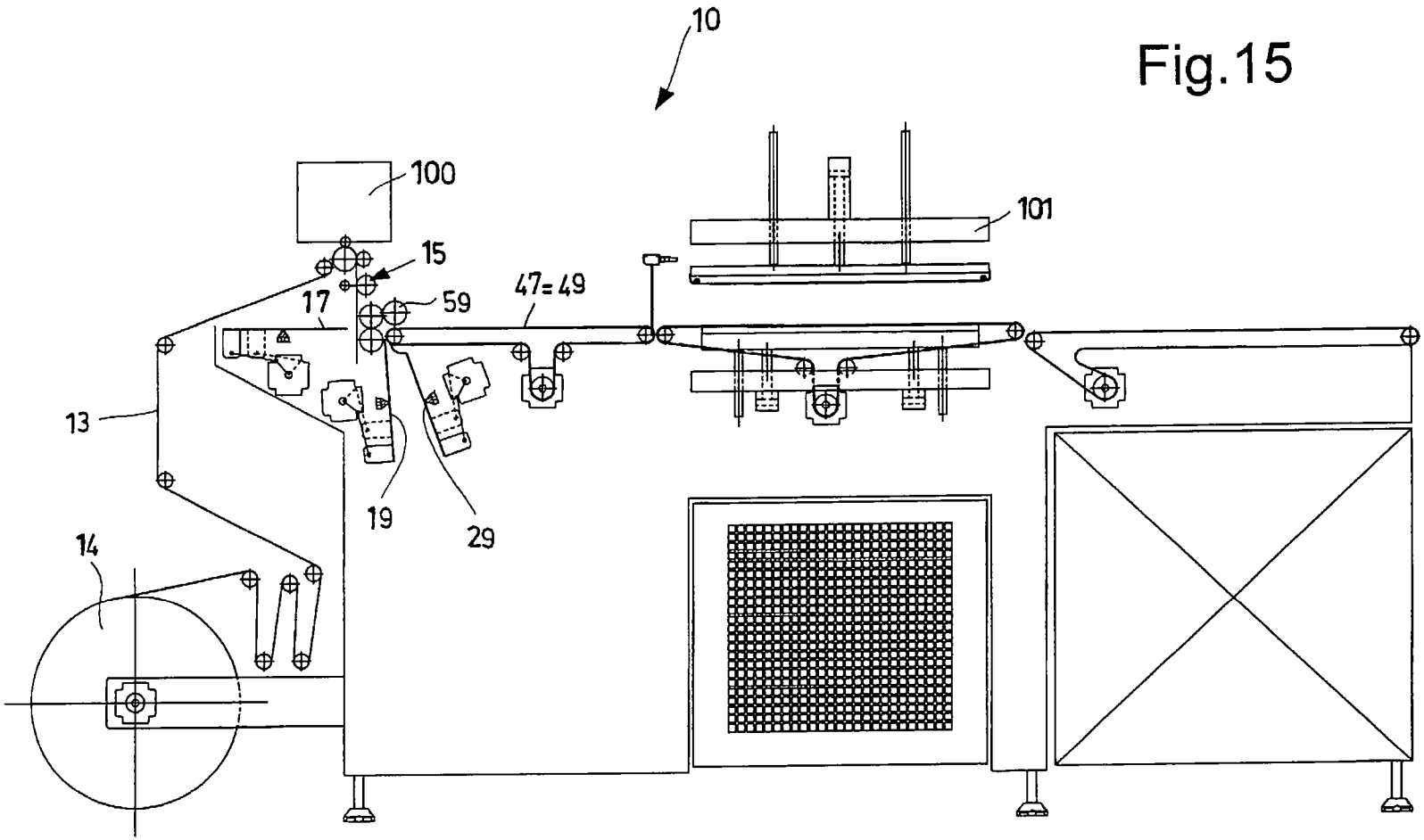
FIG. 15 is an elevation view of an apparatus comprising the assembly of FIG. 1.
Figure 16:
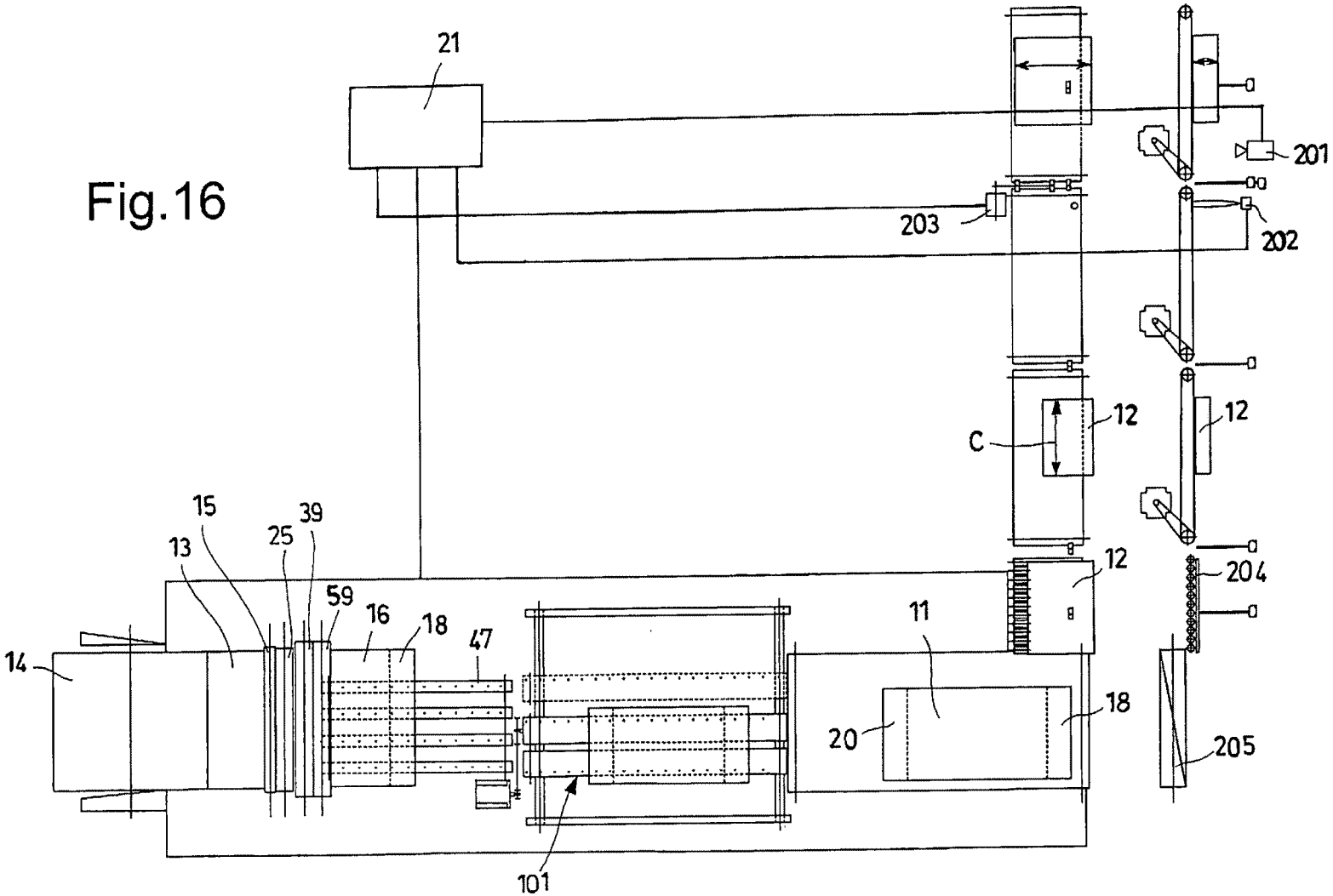
FIG. 16 is a top view of the apparatus of FIG. 15.

Moreover, it is also provided for there to be the aid through a mobile guide 29, FIG. 12, which is shaped so as to avoid possible curling of the end 20, while it is being pulled back on the belt 47, FIGS. 13 and 14. As a further provision also the two rollers 59, 39 can be slightly misaligned so as to achieve a direction of the discharge of the pocket 20.

Preferably, since such a mobile guide 29 must collaborate with the belt 17, both these elements are shaped as a comb or fork capable of compenetrating without colliding against one another.

The longitudinal welder 101, which is suitable for both closing superiorly and inferiorly the pockets 18 and 20 and regulating the height of the cover itself, acts upon the cover thus formed.

It has thus been seen that an assembly and a method for realizing in continuous covering jackets for book elements of different dimensions starting from a film wrapped up in a coil according to the present invention achieve the purposes previously highlighted.

Indeed the assembly and the method according to the present invention for realizing in continuous covering jackets for book elements of different dimensions starting from a film wrapped up in a coil make it possible to produce covering jackets of the dimensions of the book required each time, and to allow it to be personalized graphically with a title, subject, class, logo, name of the client or student, price, bar code or sorting and identification codes of the book or product.

Advantageously, the dimensional specifications can be received remotely, read by the assembly itself or inserted manually.

The assembly and the method for realizing in continuous covering jackets for book elements of different dimensions starting from a film wrapped up in a coil of the present invention thus conceived may undergo numerous modifications and variants, all covered by the same inventive concept; moreover, all the details can be replaced by technically equivalent elements. In practice, the materials used, as well as their dimensions, may be of any type according to the technical requirements.

The invention claimed is:

1. An assembly for creating a plurality of different sized continuous covering jackets for respective book elements having different dimensions, the plurality of different sized continuous covering jackets starting from a film wrapped up in a coil, said assembly comprising:

a cutting device having a movable blade to cut said film unrolling from said coil to provide pieces of said film, each piece having a first end and a second end;

a first folding device configured to form a first fold at a distance from a position of said first end of each of said pieces of said film;

a second folding device configured to form a second fold at a distance from a position of said second end of each of said pieces of said film; and a control and command unit configured to:

receive predetermined dimensions for each respective book element of said plurality of book elements, said predetermined dimensions comprising a height dimension and a width dimension for each respective book element, and control said cutting device and at least one of said first and second folding devices according to said predetermined dimensions of each of said book elements such that said first and second folds are distanced from each other based on the height dimension and the width dimension received for each respective book element to form each respective continuous covering jacket, wherein said first folding device comprises a first pair of rollers spring biased in mutual contact with each other in order to provide a first calendar passage for said film, and a first movable folding knife which moves into contact with the film at said distance from the position of the first end and continues movement to force said film, in opposition to said spring bias, into said first calendar passage to form said first fold.

2. An assembly according to claim 1, further comprising an aspirated belt placed downstream of said first calendar passage for receiving and constraining said first end having the first fold.

3. An assembly according to claim 1, wherein said second folding device comprises a second pair of rollers spring biased in mutual contact with each other in order to provide a second calendar passage for said film, and a second movable folding knife which moves into contact with the film at said distance from the position of the second end and continues movement to force said film, in opposition to said spring bias, into said second calendar passage to form said second fold.

4. An assembly according to claim 3, further comprising an aspirated belt activatable in opposite directions to selectively feed and remove said film from said second pair of rollers.

5. An assembly according to claim 4, further comprising a guide for receiving said second end having said second fold and for directing the second end onto said aspirated belt.

6. An assembly according to claim 5, wherein said second pair of rollers and said aspirated belt of said second folding device respectively coincide with said first roller and said aspirated belt of said first folding device.

7. An assembly according to claim 1, further comprising a welding and longitudinal cutting device placed downstream of said second folding device and configured to weld and cut said folded piece.

8. The assembly of claim 1, wherein said first pair of rollers are spring biased in mutual direct contact with each other in order to define said first calendar passage for said film.

9. The assembly of claim 1, wherein said control and command unit is configured to control at least one of said cutting device and said first folding device such that a cutting operation to form said second end of each piece is performed only after starting a folding operation to form said first fold.

10. An assembly according to claim 7, wherein said control and command unit is configured to receive a height dimension of each respective book element and to control said welding and longitudinal cutting device to weld and cut said piece, after forming said first and second folds, based on the height dimension.

11. A method for creating a plurality of different sized continuous covering jackets for respective book elements having different dimensions, the plurality of different sized continuous covering jackets starting from a film wrapped up in a coil, said method comprising:

cutting said film unrolling from said coil to provide pieces of said film each piece having a first end and a second end;

forming a first fold at a distance from a position of said first end of each of said pieces of said film;

forming a second fold at a distance from a position of said second end of each of said pieces of said film wherein at least one of said forming a first fold and said forming a second fold comprises moving a knife into contact with the film at said distance from a position of a respective end, and continuing movement of the knife to force the film into a calendar formed by rollers which are spring biased in mutual contact, such that the film folds about opposing sides of the knife;

receiving in a command and control unit predetermined dimensions for each respective book element of said plurality of book elements, said predetermined dimensions comprising a height dimension and a width dimension for each respective book element, and coordinating with the control and command unit said cutting and said forming a first and second fold according to predetermined dimensions of each of said book elements such that said first and second folds are distanced from each other based on the height dimension and the width dimension received for each respective book element to form each respective continuous covering jacket;

longitudinally welding said film folded in order to close said folded ends and to regulate a height of said film according to the predetermined dimensions of said book elements.

12. A method according to claim 11, wherein at least one of said forming a first fold and forming a second fold comprises:

actuating pairs of rollers each pair being spring biased in mutual contact with each other in order to realize calendar passages for said film, using two folding knives as to force said film into said calendar passages, and providing an aspirated belt placed downstream of said rollers.

13. A method according to claim 11, further comprising detecting the predetermined dimensions of said book elements and transmitting dimension data to said control and command unit to effect said cutting and said folding based on the dimension data.

14. The method of claim 11, wherein said folding a second end of each of said pieces of said film comprises continuing movement of the knife to force the film into a calendar defined by rollers which are spring biased in mutual direct contact.

15. The method of claim 11, wherein a cutting operation to form said second end of each piece is performed only after starting a folding operation to form said first fold.

16. The method of claim 11, further comprising receiving a height dimension of each respective book element, and said longitudinally welding is performed based on the height dimension.

* * * * *